US010765179B2

(12) United States Patent
Ekko et al.

(10) Patent No.: US 10,765,179 B2
(45) Date of Patent: Sep. 8, 2020

(54) SLIDE FASTENER

(71) Applicant: YKK Corporation, Tokyo (JP)

(72) Inventors: Tomoyuki Ekko, Kurobe (JP); Yusuke Hosokawa, Kurobe (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/625,106

(22) PCT Filed: Jun. 22, 2017

(86) PCT No.: PCT/JP2017/023059
§ 371 (c)(1),
(2) Date: Dec. 20, 2019

(87) PCT Pub. No.: WO2018/235235
PCT Pub. Date: Dec. 27, 2018

(65) Prior Publication Data

US 2020/0146402 A1 May 14, 2020

(51) Int. Cl.
*A44B 19/34* (2006.01)
*A44B 19/38* (2006.01)

(52) U.S. Cl.
CPC ..... *A44B 19/34* (2013.01); *A44B 19/38* (2013.01)

(58) Field of Classification Search
CPC ..... A44B 19/00; A44B 19/24; A44B 19/34; A44B 19/38
See application file for complete search history.

(56) References Cited

U.S. PATENT DOCUMENTS 4,976,016 A 12/1990 Takabatake
8,661,628 B2 * 3/2014 Keyaki ..... A44B 19/388 24/386
10,016,025 B1 * 7/2018 Lin ..... A44B 19/26
2005/0278904 A1 12/2005 Matsumoto et al.

FOREIGN PATENT DOCUMENTS

JP H02-128702 A 5/1990
JP 4176052 B2 11/2008

OTHER PUBLICATIONS

International Search Report, PCT Patent Application No. PCT/JP2017/023059, dated Sep. 19, 2017.
Written Opinion, PCT Patent Application No. PCT/JP2017/023059, dated Sep. 19, 2017.

* cited by examiner

*Primary Examiner* — Robert Sandy
*Assistant Examiner* — David M Upchurch
(74) *Attorney, Agent, or Firm* — Kilpatrick Townsend & Stockton LLP

(57) ABSTRACT

There is provided a slide fastener with a separable stop including a retainer pin and a separable pin. The separable pin has a projection configured to be engaged with a fastener element. The slider includes a raised portion. For example, the raised portion extends on a lower surface of the upper plate rearward from a periphery of the guide post and is raised from the lower surface of the upper plate toward the lower plate. The raised portion of the slider and the separable pin have respective contact portions configured to come in contact with each other in a moving direction of the slider. At least one of the contact portion of the raised portion of the slider and the contact portion of the separable pin is provided with an intersecting portion obliquely intersecting with the moving direction of the slider.

9 Claims, 12 Drawing Sheets

SLIDE FASTENER

TECHNICAL FIELD

The present invention relates to a slide fastener having a separable stop.

BACKGROUND ART

Conventionally, a slide fastener has been known, which has a separable stop constituted of a separable pin, a retainer pin and a retainer box, and also has a projection formed on a top end of the separable pin (e.g., see Patent Document 1). When right and left fastener elements are engaged with each other, the projection is engaged with a fastener element on the opposing side.

PRIOR ART DOCUMENT

Patent Document

Patent Document 1: Japanese Patent No. 4176052 B2

SUMMARY OF INVENTION

Problems to be Solved by Invention

However, in the conventional slide fastener as described above, there is a possibility that even when a slider is pulled down until coming in contact with the retainer box, the projection of the separable pin and the fastener element are not disengaged from each other and thus the separable pin cannot be removed from the retainer box.

The present invention has been made keeping in mind the above problems, and an object thereof is to provide a slide fastener, in which when a slider is pulled down until coming in contact with a retainer box, a projection of a separable pin and a fastener element are disengaged from each other, thereby ensuring that the separable pin can be reliably removed from the retainer box.

Means for Solving Problems

The object of the present invention is achieved by the following configurations.

(1) A slide fastener, including: a pair of fastener tapes; a pair of fastener element rows respectively attached to opposing side edge portions of the pair of fastener tapes; a slider for engaging and disengaging the pair of fastener element rows with and from each other; and a separable stop provided on one end side of the pair of fastener element rows, wherein the separable stop includes a retainer pin provided on one of the fastener tapes; and a separable pin provided on the other of the fastener tapes, wherein the separable pin has a projection configured to be engaged with a fastener element at one end of one of the fastener element row on the one of the fastener tapes, wherein the slider includes: an upper plate and a lower plate which are arranged to be spaced from each other in an upper and lower direction and to be parallel to each other; a guide post connecting the upper plate with the lower plate at front end portions thereof; and a raised portion configured in such a manner that the raised portion extends on a lower surface of the upper plate rearward from a periphery of the guide post and is raised from the lower surface of the upper plate toward the lower plate, or that the raised portion extends on an upper surface of the lower plate rearward from the periphery of the guide post and is raised from the upper surface of the lower plate toward the upper plate, wherein the raised portion of the slider and the separable pin have respective contact portions configured to come in contact with each other in a moving direction of the slider, and wherein at least one of the contact portion of the raised portion of the slider and the contact portion of the separable pin is provided with an intersecting portion obliquely intersecting with the moving direction of the slider.

(2) The slide fastener according to the above (1), wherein the separable pin has a main body portion, wherein the main body portion includes a side surface facing the retainer pin; a base protruding toward a front side of the main body portion and protruding from the side surface toward the retainer pin; the projection protruding forward from a front surface of the base; and the contact portion located at the rear of the projection and above the base and included in the side surface, wherein the intersecting portion is provided on the contact portion of the separable pin and the intersecting portion has an apex at a site on the intersecting portion, which is located closest to the retainer pin, and a starting point at a site on the intersecting portion, which is located at a frontmost portion of the separable pin, wherein the contact portion of the raised portion of the slider is a distal end portion configured to come in contact with the contact portion of the separable pin, and wherein in a state where the projection of the separable pin is engaged with the fastener element, the apex of the intersecting portion is positioned closer to the retainer pin relative to an apex of the distal end portion of the raised portion of the slider, and the starting point of the intersecting portion is positioned away from the retainer pin relative to the apex of the distal end portion of the raised portion of the slider.

(3) The slide fastener according to the above (2), wherein a width of the separable pin as measured at the apex of the intersecting portion is smaller than a width of a separable pin guide groove of the slider for guiding insertion of the separable pin.

(4) The slide fastener according to the above (2) or (3), wherein a width of the separable pin as measured at the rear of the intersecting portion is smaller than a width of the separable pin as measured at the apex (A) of the intersecting portion.

(5) The slide fastener according to any one of the above (1) to (4), wherein the intersecting portion is an inclined surface.

(6) The slide fastener according to the above (5), wherein the inclined surface extends rearward from a corner portion of the separable pin toward the retainer pin.

(7) The slide fastener according to the above (5) or (6), wherein a dimension H1 of the separable pin in the upper and lower direction, a dimension H2 between the lower surface of the upper plate of the slider and the upper surface of the lower plate of the slider in the upper and lower direction, and a dimension H3 of the contact portion of the raised portion of the slider in the upper and lower direction have a relationship of $H3>(H2-H1)$.

(8) The slide fastener according to any one of the above (1) to (7), wherein when the slide fastener is a slide fastener in which the fastener element rows are arranged on lower surfaces of the fastener tapes, the raised portion of the slider is provided on the upper plate of the slider and the contact portion of the separable pin is provided on an upper surface side of the fastener tapes.

(9) The slide fastener according to any one of the above (1) to (7), wherein when the slide fastener is a slide fastener in which the fastener element rows are arranged on upper surfaces of the fastener tapes, the raised portion of the slider is provided on the lower plate of the slider and the contact portion of the separable pin is provided on a lower surface side of the fastener tapes.

Advantageous Effects of Invention

According to the present invention, the raised portion of the slider and the separable pin have respective contact portions configured to come in contact with each other in a moving direction of the slider. Also, at least one of the contact portion of the raised portion of the slider and the contact portion of the separable pin is provided with an intersecting portion obliquely intersecting with the moving direction of the slider. As a result, when the slider is pulled down until coming in contact with the retainer box, the contact portion of the slider comes in contact with the contact portion of the separable pin and thus the separable pin moves in a direction opposite to the retainer pin, i.e., in a direction away from the retainer pin. Therefore, the projection of the separable pin and the fastener element are disengaged from each other, thereby ensuring that the separable pin can be reliably removed from the retainer box.

EMBODIMENTS OF INVENTION

Hereinafter, one embodiment of a slide fastener according to the present invention will be described in detail with reference to the accompanying drawings. In the following description, an upper side refers to a near side with respect to the paper surface of FIG. 1; a lower side refers to a far side with respect to the paper surface of FIG. 1; a front side refers to an upper side with respect to the paper surface of FIG. 1; a rear side refers to a lower side with respect to the paper surface of FIG. 1; a left side refers to a left side with respect to the paper surface of FIG. 1; and a right side refers to a right side with respect to the paper surface of FIG. 1. A right and left direction is also referred to as a widthwise direction. In addition, a front and rear direction is also referred to as a lengthwise direction.

Figure 1:
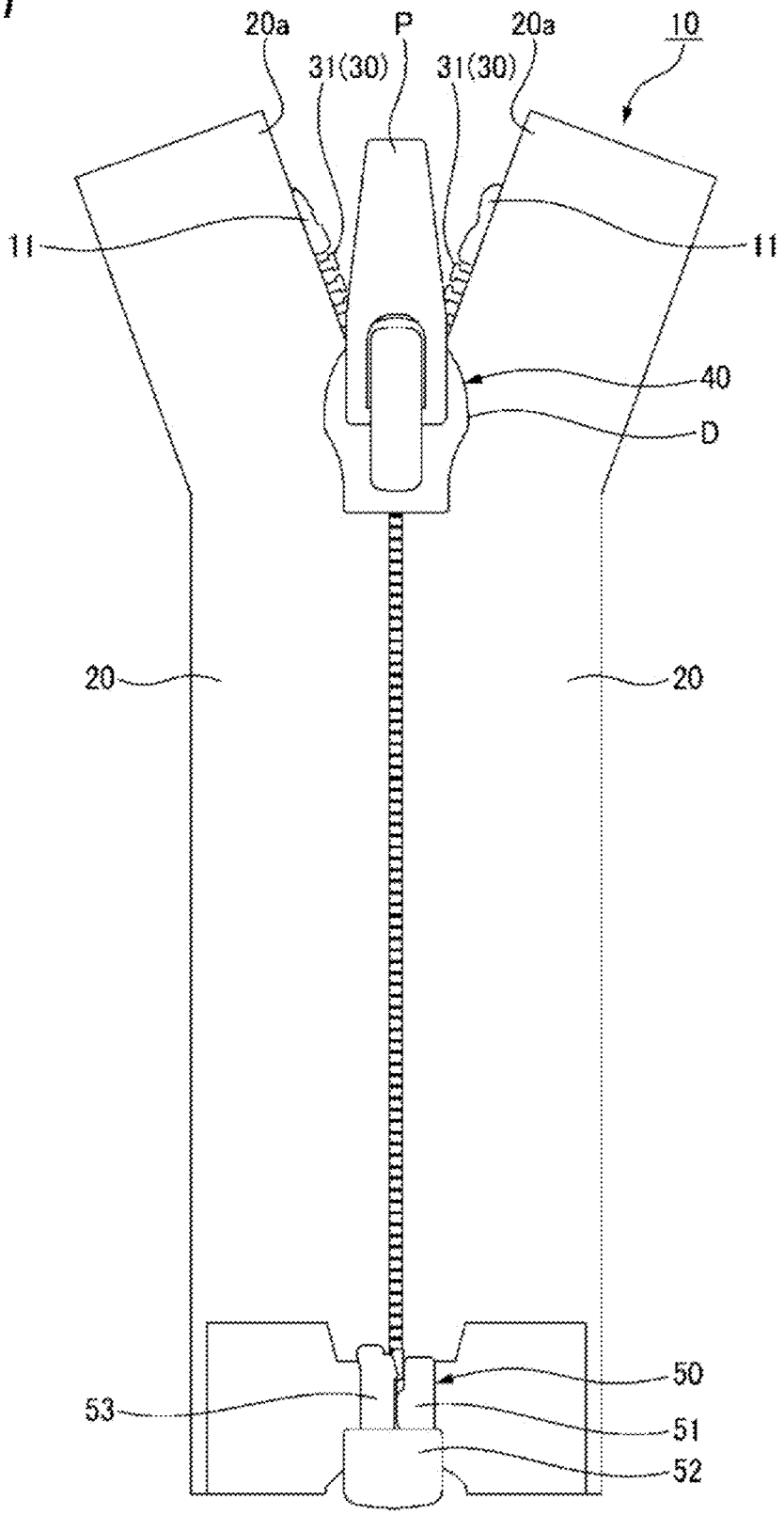
FIG. 1 is a top view explaining one embodiment of a slide fastener according to the present invention.

As shown in FIG. 1, a slide fastener 10 of the present embodiment includes a pair of right and left woven knitted fastener tapes 20; a pair of right and left fastener element rows 30 respectively attached to opposing tape side edge portions 20*a* of the right and left fastener tapes 20; a slider 40 for engaging and disengaging the right and left fastener element rows 30 with and from each other; a top stop 11 provided respectively on front end sides of the right and left fastener element rows 30; and a separable stop 50 provided on rear end sides of the right and left fastener element rows 30. In addition, the slide fastener 10 is a for-back-side slide fastener with the fastener element rows 30 arranged on lower surfaces of the fastener tapes 20.

Each of the fastener element rows 30 is a coil-shaped fastener element row formed by winding synthetic resin monofilament in a predetermined direction and has a plurality of fastener elements 31. Then, the fastener element rows 30 are sewn on a lower surface (back surface) of the tape side edge portion 20*a* of the respective fastener tapes 20 with a sewing yarn (not shown). In addition, a synthetic resin material for the monofilament may include polyester, nylon or the like.

Figure 2:
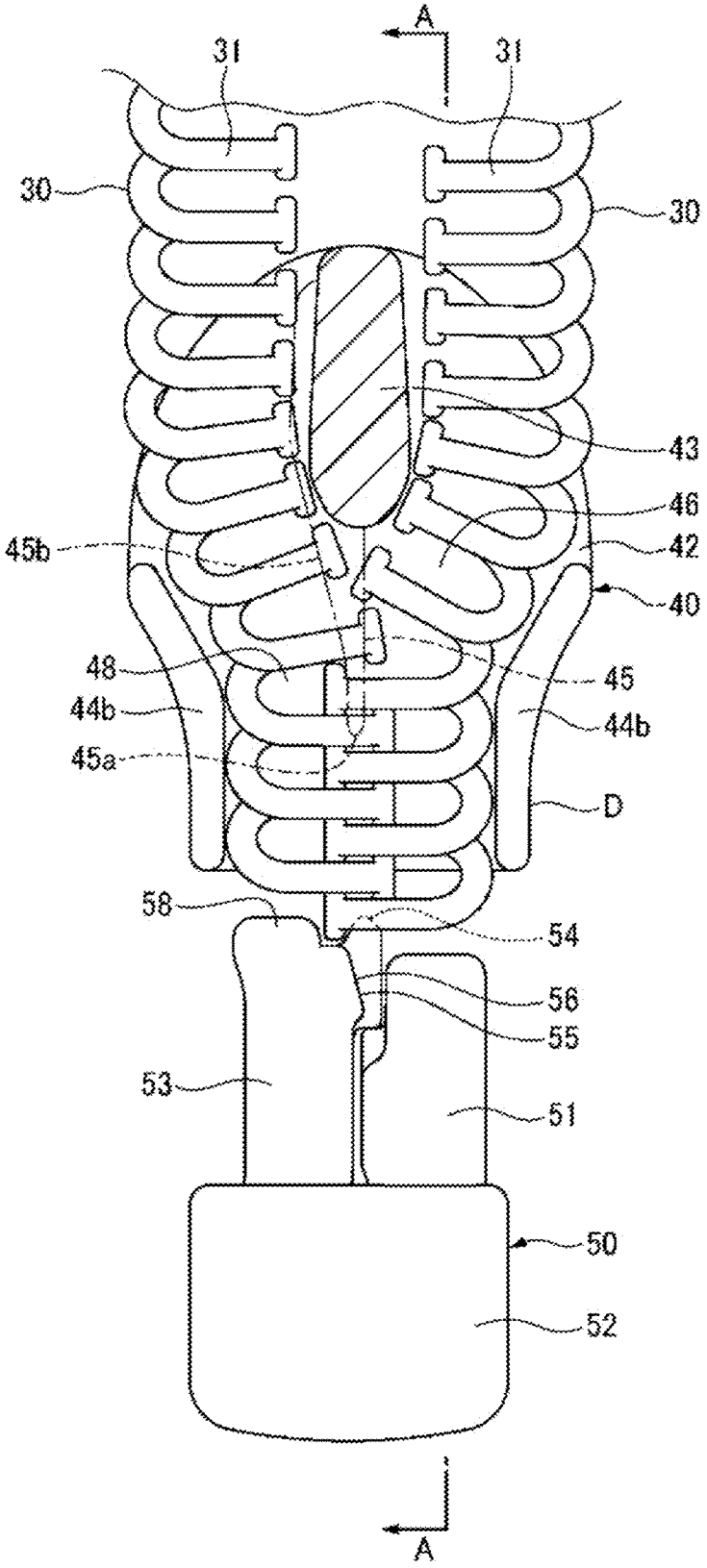
FIG. 2 is a partially broken top view showing a periphery of a slider and separable stop shown in FIG. 1.
Figure 3:
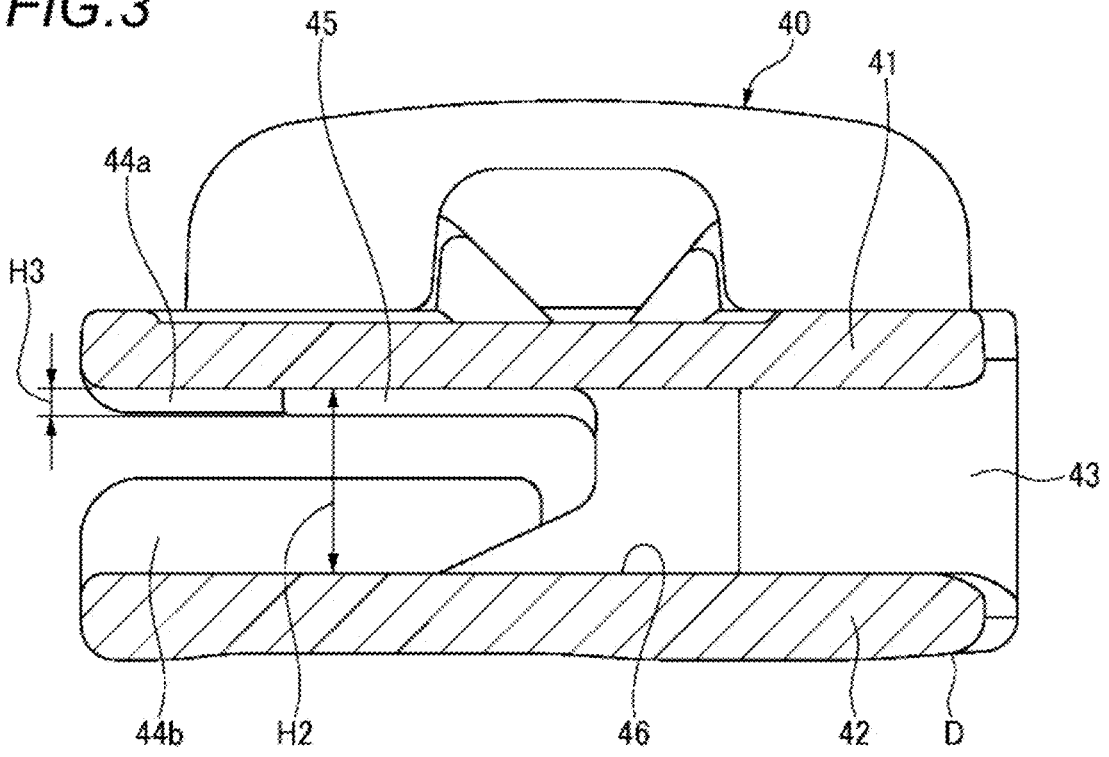
FIG. 3 is a sectional view of the slider taken along a line A-A in FIG. 2.

As shown in FIGS. 2 and 3, the slider 40 includes a slider body D and a pull P attached to an upper surface of the slider body D. Then, the right and left fastener element rows 30 are engaged with each other by moving the slider 40 toward the top stops 11, whereas the right and left fastener element rows 30 are disengaged from each other by moving the slider 40 toward the separable stop 50. Meanwhile, the slider 40 in the present embodiment is a slider having an automatic stop function. Alternatively, a slider having no automatic stop function may be employed.

The slider body D includes an upper plate 41 and a lower plate 42 which are arranged to be spaced from each other in an upper and lower direction and to be parallel to each other; a guide post 43 connecting the upper plate 41 with the lower plate 42 at front end portions thereof; flanges 44*a* protruding downward from left and right side edges of the upper plate 41; flanges 44*b* protruding upward from left and right side edges of the lower plate 42; a raised portion 45 formed on a lower surface of the upper plate 41 and configured to guide the right and left fastener element rows 30. Also, a generally Y-shaped element guide passage 46 allowing the right and left fastener element rows 30 to be inserted therethrough is formed between the upper plate 41 and the lower plate 42. Further, tape grooves allowing the respective fastener tapes 20 to be inserted therethrough are respectively formed between upper and lower flanges 44*a*, 44*b*.

The raised portion 45 is a portion extending on the lower surface of the upper plate 41 rearward from the periphery of the guide post 43 and raised from the lower surface of the upper plate 41 toward the lower plate 42. Also, a rear distal end portion of the raised portion 45 forms a distal end portion (contact portion of the raised portion 45) 45*a* configured to come in contact with a contact portion 55 of the separable pin 53 as described below. Meanwhile, in the present embodiment, the distal end portion 45*a* of the raised portion 45 has a circular arc shape, and a region within the circular arc range is referred to as the distal end portion 45*a*. A site, which is located on the rearmost side of the distal end portion 45*a*, is referred to as an apex of the distal end portion 45*a*. Also, an element guide surface 45*b* for guiding the left fastener element row 30 is formed on a left surface of the raised portion 45. The element guide surface 45*b* is formed in such a shape that an extent of protrusion of a front portion thereof into the element guide passage 46 is large and an extent of protrusion of a rear portion thereof into the element guide passage 46 is small. Due to the element guide surface 45*b*, the separable pin 53 can be smoothly removed without interfering with the guide post 43 of the slider 40 when the separable pin 53 is removed from the retainer box 52 and then the slider 40.

The separable stop 50 includes a retainer pin 51 and a retainer box 52, which are formed on a rear end portion of the tape side edge portion 20*a* of the right fastener tape 20, and a separable pin 53, which is formed on a rear end portion of the tape side edge portion 20*a* of the left fastener tape 20 and is capable of being inserted into the retainer box 52.

Figure 4A:
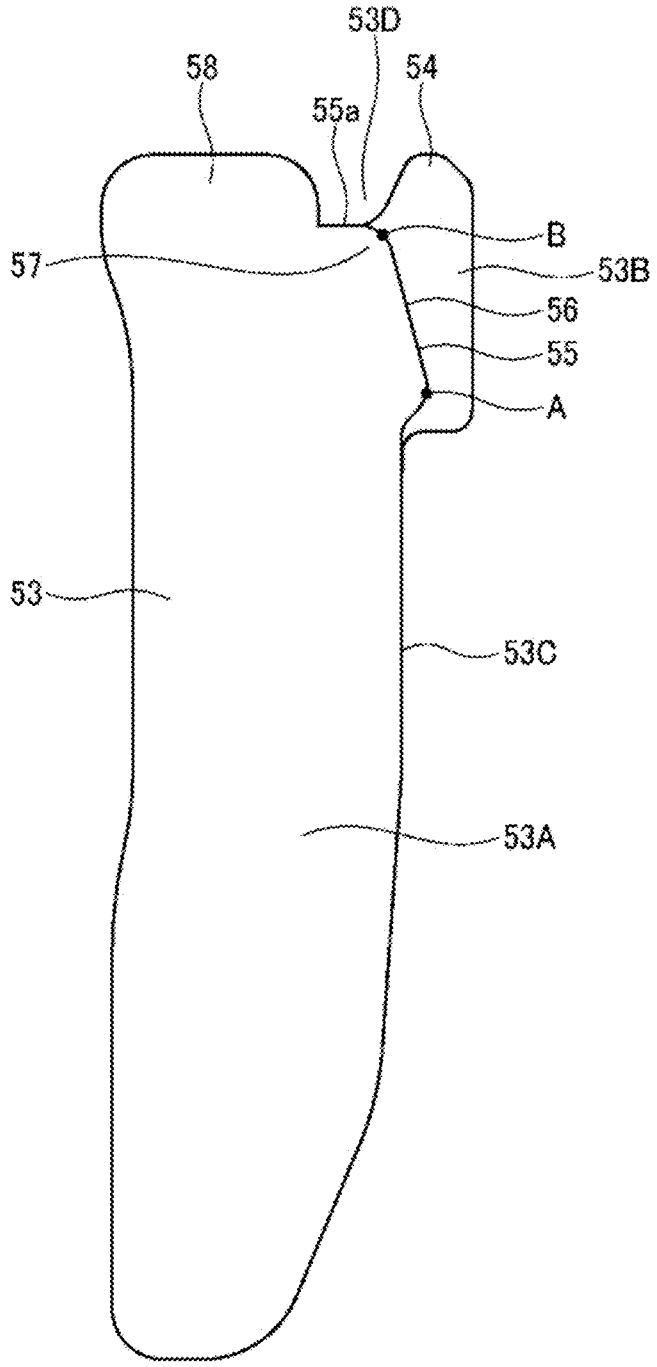
FIG. 4A is a top view of a separable pin.
Figure 4B:
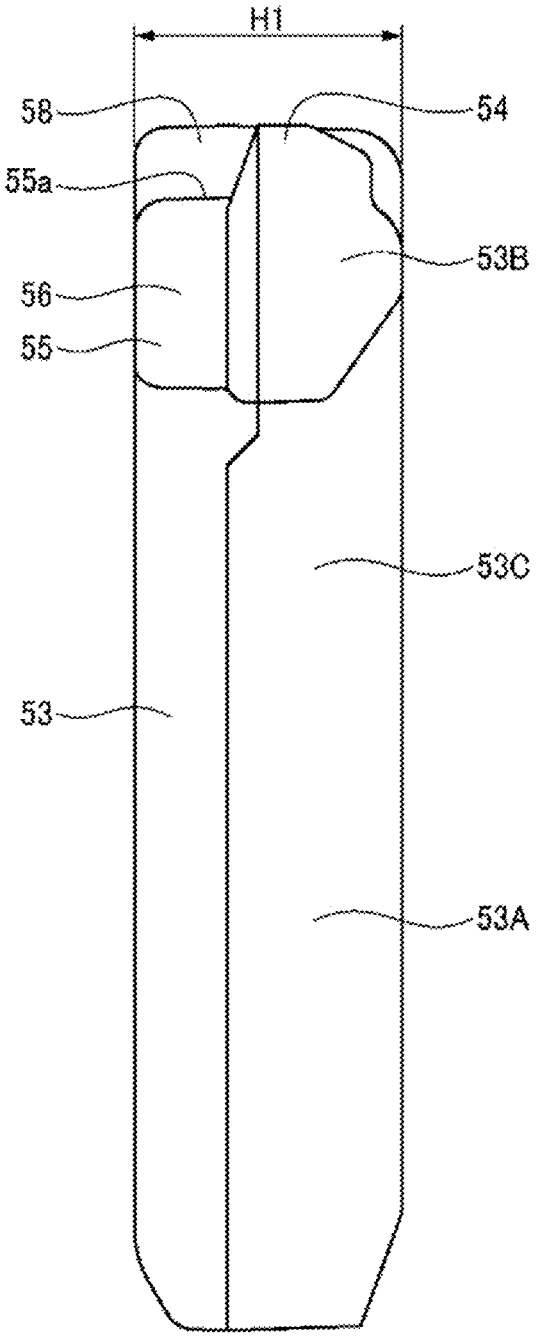
FIG. 4B is a right view of the separable pin.
Figure 4C:
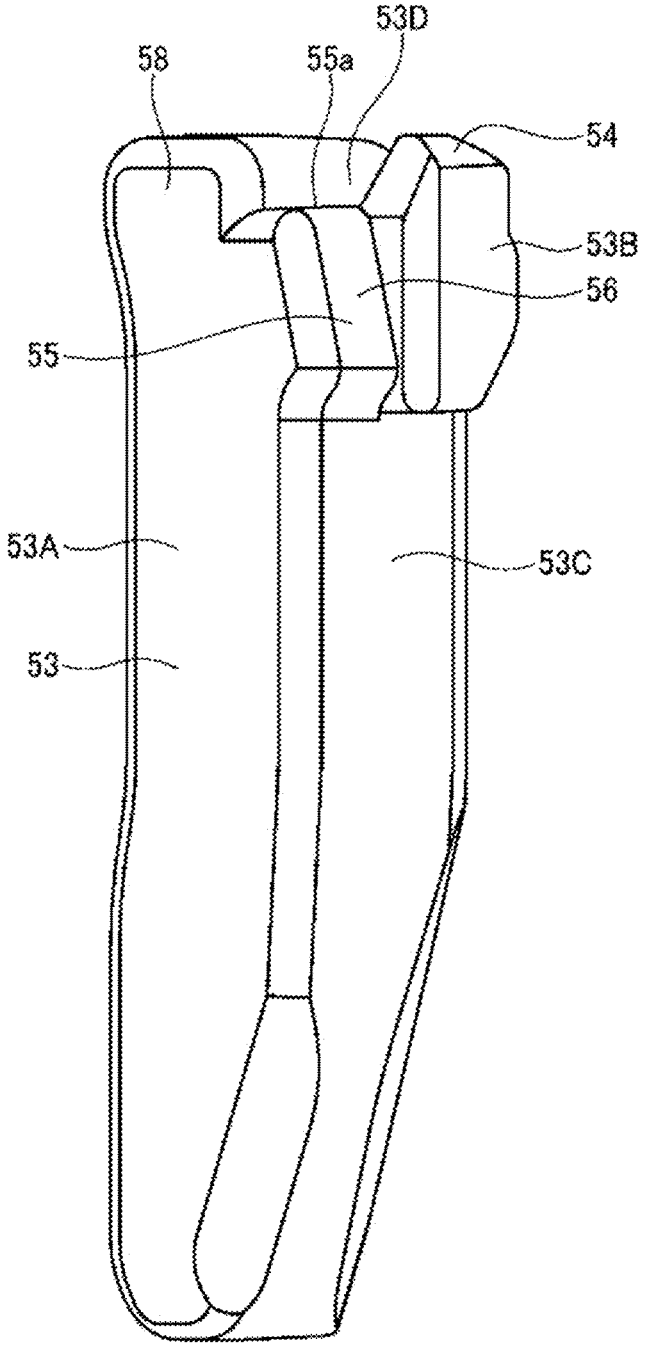
FIG. 4C is a perspective view of the separable pin as viewed from the right.
Figure 5:
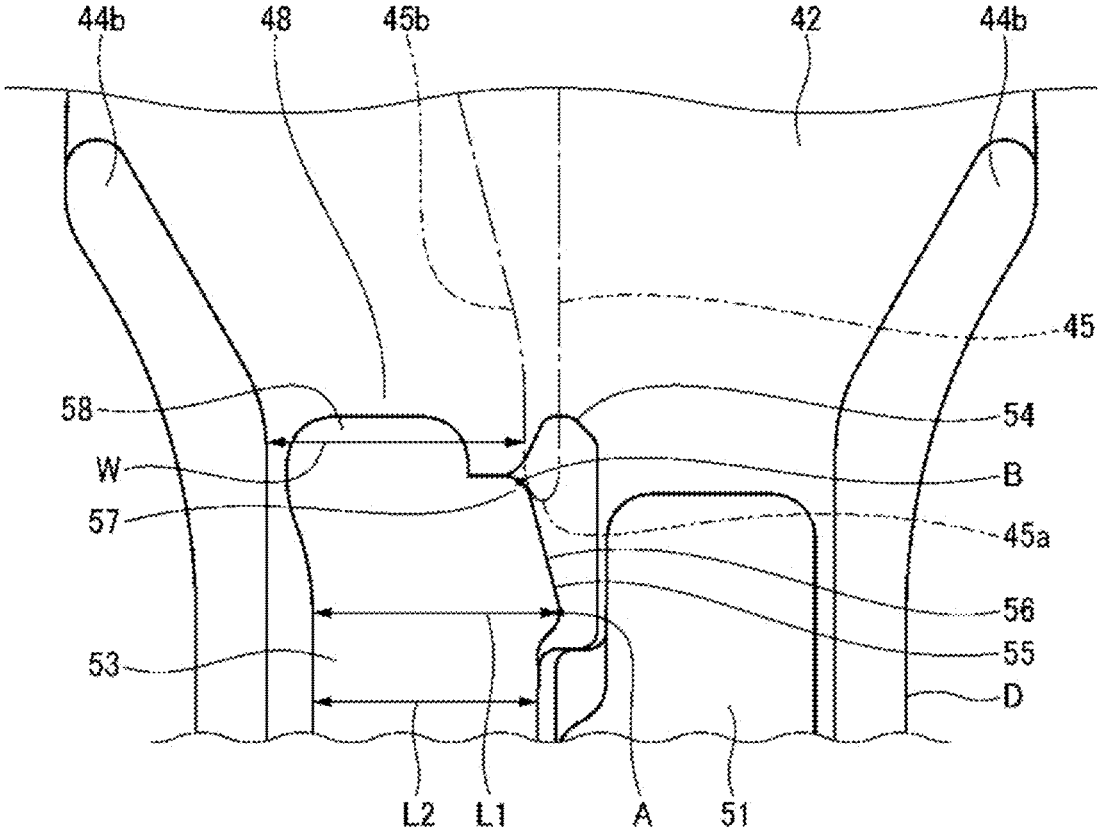
FIG. 5 is an enlarged top view showing a relationship between a raised portion of the slider and an inclined surface of a contact portion of the separable pin.

As shown in FIGS. 4 and 5, the separable pin 53 has a prism-shaped main body portion 53A. The main body portion 53A has a side surface 53C facing the retainer pin 51, and a base 53B protruding toward a front side of the main body portion 53A and protruding from the side surface 53C toward the retainer pin 51. The base 53B is continuous to the side surface 53C. Also, the base 53B has a projection 54 formed to be engaged with a fastener element 31 at the rearmost end of the right fastener element row 30. The projection 54 is formed in such a shape that the projection 54 protrudes forward relative to a front surface 55*a* of the main body portion 53A as described below. Also, a protrusion 58 is formed to protrude forward from a site on the front surface 55*a* of the main body portion 53A, which is located at a distance from the retainer pin 51. Further, a receiving portion 53D is provided between the projection 54 and the protrusion 58 to receive a rear half of an engaging head of the fastener element 31 therein.

Also, a contact portion 55 is formed at a location on the side surface 53C of the separable pin 53, which is located in the rear of the projection 54 and above the base 53B. The contact portion 55 has an inclined surface (intersecting portion obliquely intersecting with a moving direction of the slider 40) 55 configured to come in contact with the distal end portion 45*a* of the raised portion 45 of the slider 40. Is addition, the contact portion 55 is provided on the upper surface side of the fastener tape 20. Therefore, the distal end portion 45*a* of the raised portion 45, which is the contact portion of the slider 40, and the contact portion 55 of the separable pin 53 are configured to come in contact with each other in the moving direction of the slider 40 (front and rear direction).

The inclined surface 56 is formed to extend rearward from a right end portion of the front surface 55*a* extending in a widthwise direction of the main body portion 53A and has an apex A on a rear end thereof and a starting point B on a front end thereof. The apex A is a site on the inclined surface 56, which is located closest to the retainer pin 51. The starting point B is a site on the inclined surface 56, which is located at a frontmost portion of the separable pin 53. Also, as shown in FIG. 5, in a state where the projection 54 of the separable pin 53 is engaged with the right fastener element 31, the apex A of the inclined surface 56 is positioned closer to the retainer pin 51 relative to the apex of the distal end portion 45*a* of the raised portion 45 of the slider 40, and the starting point B of the inclined surface 56 is positioned away from the retainer pin 51 relative to the apex of the distal end portion 45*a* of the raised portion 45 of the slider 40. As a result, the apex of the distal end portion 45*a* of the raised portion 45 of the slider 40 is positioned between the apex A and the starting point B of the inclined surface 56. Therefore, when the slider 40 is pulled down toward the retainer box 52, the distal end portion 45*a* of the raised portion 45 of the slider 40 comes in contact with the inclined surface 56. In addition, a portion of the inclined surface 56, which is located away from the retainer pin 51 relative to the contact point of the raised portion 45, functions to guide movement of the slider 40 in the front and rear direction, and a portion of the inclined surface 56, which is located closer to the retainer pin 51 relative to the contact point of the raised portion 45, functions to move the separable pin 53 outward in the widthwise direction (toward the left side in FIG. 5).

Also, the main body portion 53A has a corner portion 57 between the front surface 55*a* and the inclined surface 56. In addition, the inclined surface 56 is provided to be positioned rearward relative to the corner portion 57 of the main body portion 53A and closer to the retainer pin 51. Further, the inclined surface 56 is formed to gradually approach the retainer pin 51 as it goes from the corner portion 57 of the main body portion 53A toward the retainer pin 51 and toward the retainer box 52 (in the right and rear direction in FIG. 5). As a result, when the slider 40 is pulled down until coming in contact with the retainer box 52 while the projection 54 of the separable pin 53 is engaged with the fastener element 31, the distal end portion 45*a* of the raised portion 45 of the slider 40 and the inclined surface 56 of the separable pin 53 are aligned on a straight line along the front and rear direction, and the distal end portion 45*a* of the raised portion 45 of the slider 40 and the inclined surface 56 of the separable pin 53 come in contact with each other.

Also, as shown in FIG. 5, a width L1 of the separable pin 53 as measured at the apex A of the inclined surface 56 is set to be smaller than a width W of a separable pin guide groove 48 of the slider 40 for guiding insertion of the separable pin 53. As a result, the separable pin 53 is allowed to move in the widthwise direction within the separable pin guide groove 48. Meanwhile, the separable pin guide groove 48 is formed between an inner surface of the left flange 44*a* of the slider 40 and the element guide surface 45*b* of the raised portion 45.

Further, a width L2 of the separable pin 53 as measured at the rear of the inclined surface 56 is set to be smaller than the width L1 of the separable pin 53 as measured at the apex A of the inclined surface 56. That is, the side surface 53C of the separable pin 53 at the rear of the inclined surface 56 is recessed toward the left direction relative to the apex A of the inclined surface 56 so as to be spaced from the retainer pin 51. As a result, it is possible to enhance insertability of the separable pin 53 into the retainer box 52.

Further, a dimension H1 of the separable pin 53 in the upper and lower direction (see FIG. 4B), a dimension H2 between the lower surface of the upper plate 41 of the slider 40 and the upper surface of the lower plate 42 of the slider 40 in the upper and lower direction (see FIG. 3), and a dimension H3 of the distal end portion 45*a* of the raised portion 45 of the slider 40 in the upper and lower direction (see FIG. 3) have a relationship of H3>(H2-H1). Therefore, when the slider 40 is pulled down toward the retainer box 52, the distal end portion 45*a* of the raised portion 45 of the slider 40 comes in contact with the inclined surface 56.

Figure 6A:
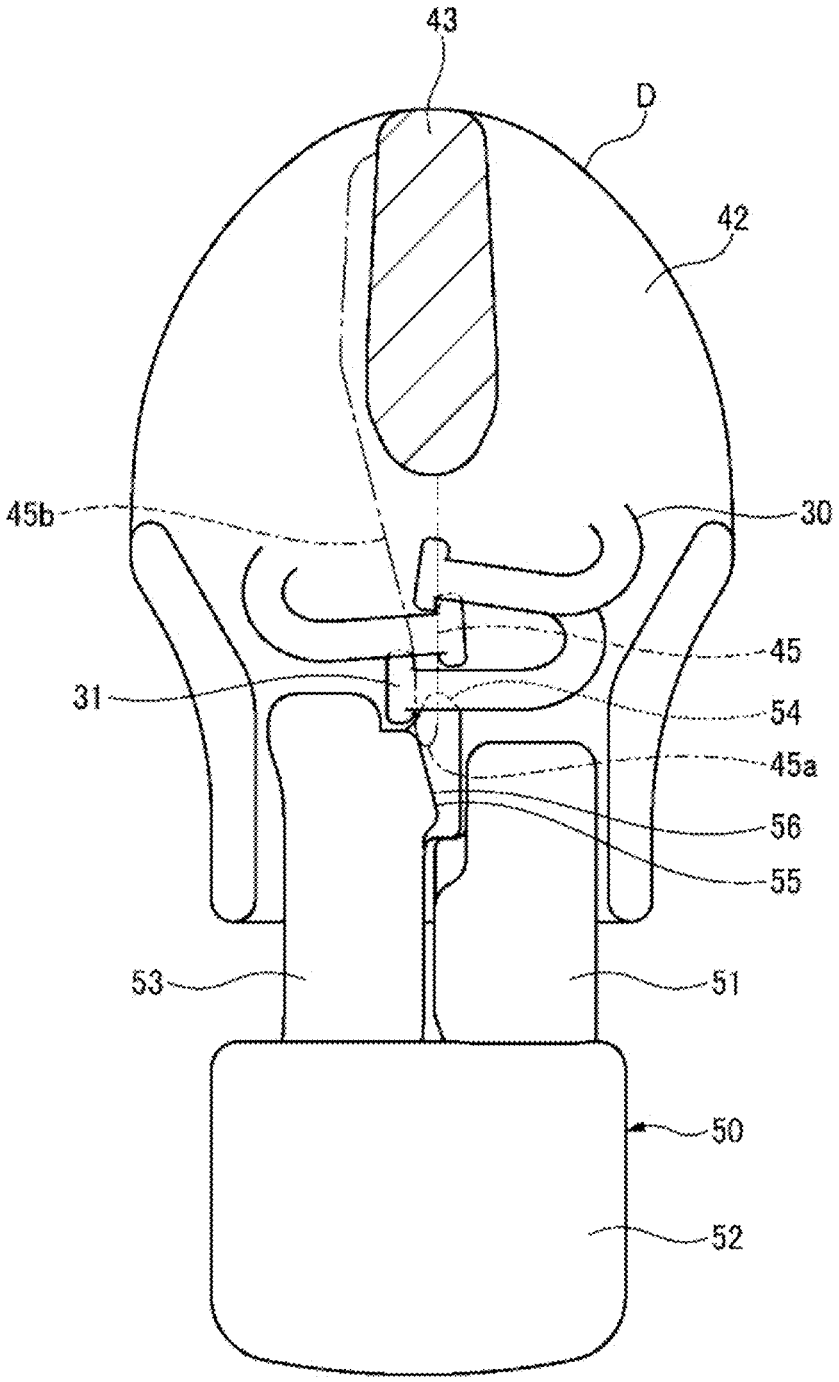
FIG. 6A is a partially broken top view showing a state where the raised portion of the slider is in contact with the inclined surface of the contact portion of the separable pin.
Figure 6B:
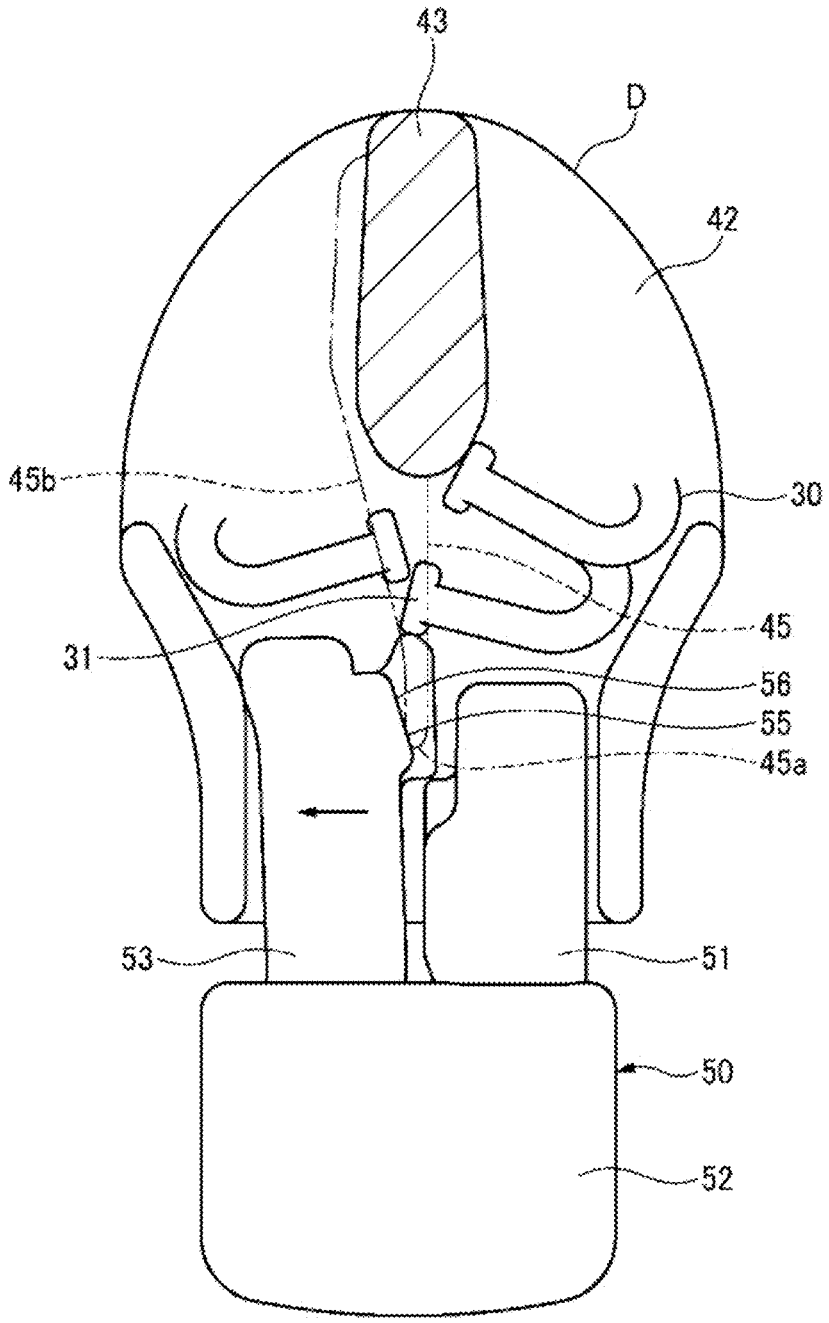
FIG. 6B is a partially broken top view showing a state where the slider is moved toward a retainer box relative to the state in FIG. 6A.
Figure 6C:
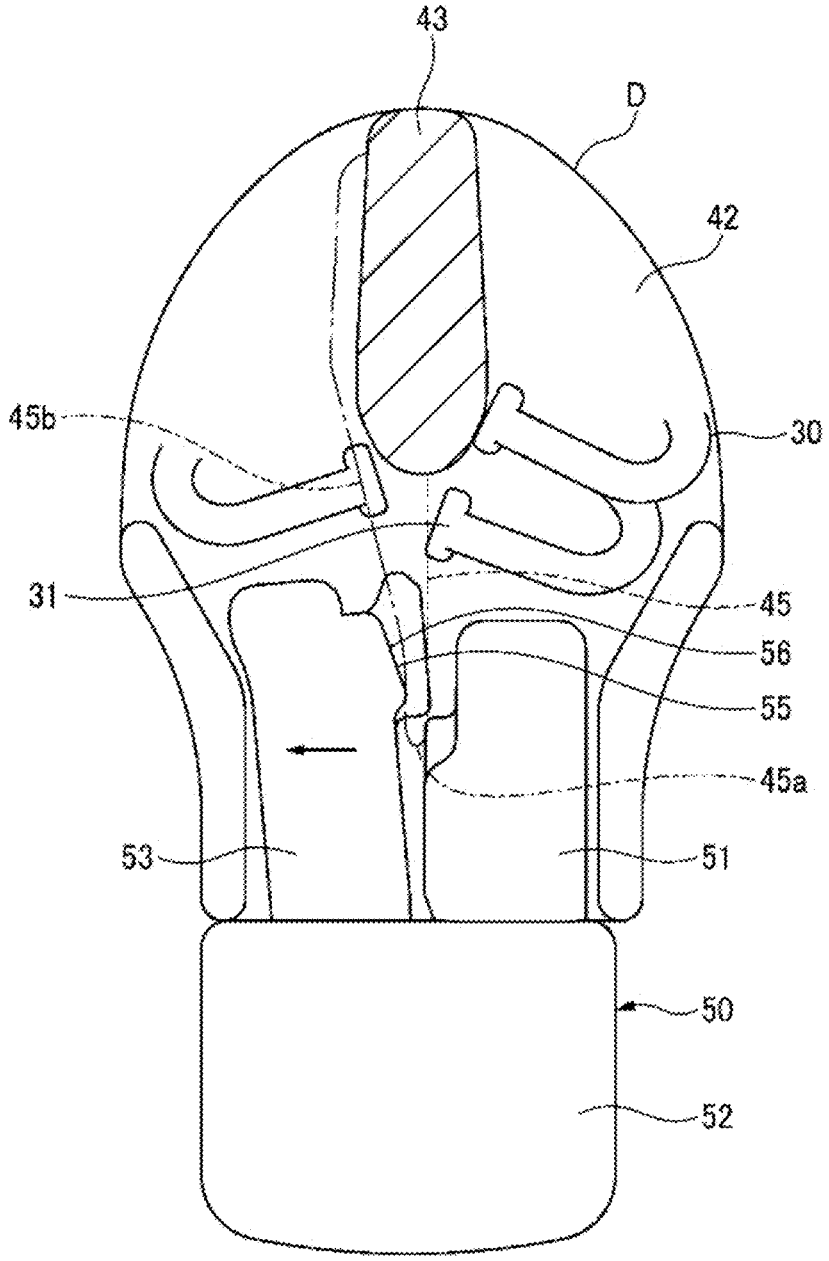
FIG. 6C is a partially broken top view showing a state where the slider is in contact with the retainer box.

In the slide fastener 10 of the present embodiment as configured as described above, as shown in FIGS. 6A to 6C, by pulling down the slider 40 until coming in contact with the retainer box 52, the distal end portion 45*a* of the raised portion 45 of the slider 40 comes in contact with the inclined surface 56 of the separable pin 53 and thus presses the inclined surface 56 outward in the widthwise direction. As a result, the projection 54 of the separable pin 53 and the right fastener element row 30 are disengaged from each other and thus the separable pin 53 is moved outward in the widthwise direction. Therefore, it is possible to reliably remove the separable pin 53 from the retainer box 52.

As described above, according to the slide fastener 10 of the present embodiment, by pulling down the slider 40 until coming in contact with the retainer box 52, the distal end portion 45*a* of the raised portion 45 of the slider 40 comes in contact with the inclined surface 56 of the separable pin 53 and thus the separable pin 53 moves in a direction opposite to the retainer pin 51, i.e., in a direction away from the retainer pin 51. Therefore, the projection 54 of the separable pin 53 and the fastener element 31 are disengaged from each other, ensuring that the separable pin 53 can be reliably removed from the retainer box 52.

Also, according to the slide fastener 10 of the present embodiment, the distal end portion 45*a* of the raised portion 45 of the slider 40 is positioned between the apex A and the starting point B of the inclined surface 56. Therefore, when the slider 40 is pulled down toward the retainer box 52, the distal end portion 45*a* of the raised portion 45 of the slider 40 can come in contact with the inclined surface 56.

Further, according to the slide fastener 10 of the present embodiment, the width L1 of the separable pin 53 as measured at the apex A of the inclined surface 56 is set to be smaller than the width W of the separable pin guide groove 48 of the slider 40. Therefore, the separable pin 53 is allowed to move in the widthwise direction within the slider 40.

Further, according to the slide fastener 10 of the present embodiment, the width L2 of the separable pin 53 as measured at the rear of the inclined surface 56 is set to be smaller than the width L1 of the separable pin 53 as measured at the apex A of the inclined surface 56. Therefore, it is possible to enhance insertability of the separable pin 53 into the retainer box 52.

Further, according to the slide fastener 10 of the present embodiment, the dimension H1 of the separable pin 53 in the upper and lower direction, the dimension H2 between the lower surface of the upper plate 41 of the slider 40 and the upper surface of the lower plate 42 of the slider 40 in the upper and lower direction, and the dimension H3 of the distal end portion 45*a* of the raised portion 45 of the slider 40 in the upper and lower direction have the relationship of H3>(H2-H1). Therefore, when the slider 40 is pulled down toward the retainer box 52, the distal end portion 45*a* of the raised portion 45 of the slider 40 can come in contact with the inclined surface 56. The dimension H3 of the distal end portion 45*a* of the raised portion 45 in the upper and lower direction is a dimension between the lower surface of the upper plate 41 of the slider 40 and a lower surface of the distal end portion 45*a* of the raised portion 45 in the upper and lower direction when the raised portion 45 is raised from the lower surface of the upper plate 41 of the slider 40, and on the other hand, is a dimension between the upper surface of the lower plate 42 and an upper surface of the distal end portion 45*a* of the raised portion 45 in the upper and lower direction when the raised portion 45 is raised from the upper surface of the lower plate 42 of the slider 40.

The present invention is not limited to the foregoing embodiments, but may be appropriately modified without departing from the spirit and scope of the present invention.

Figure 7:
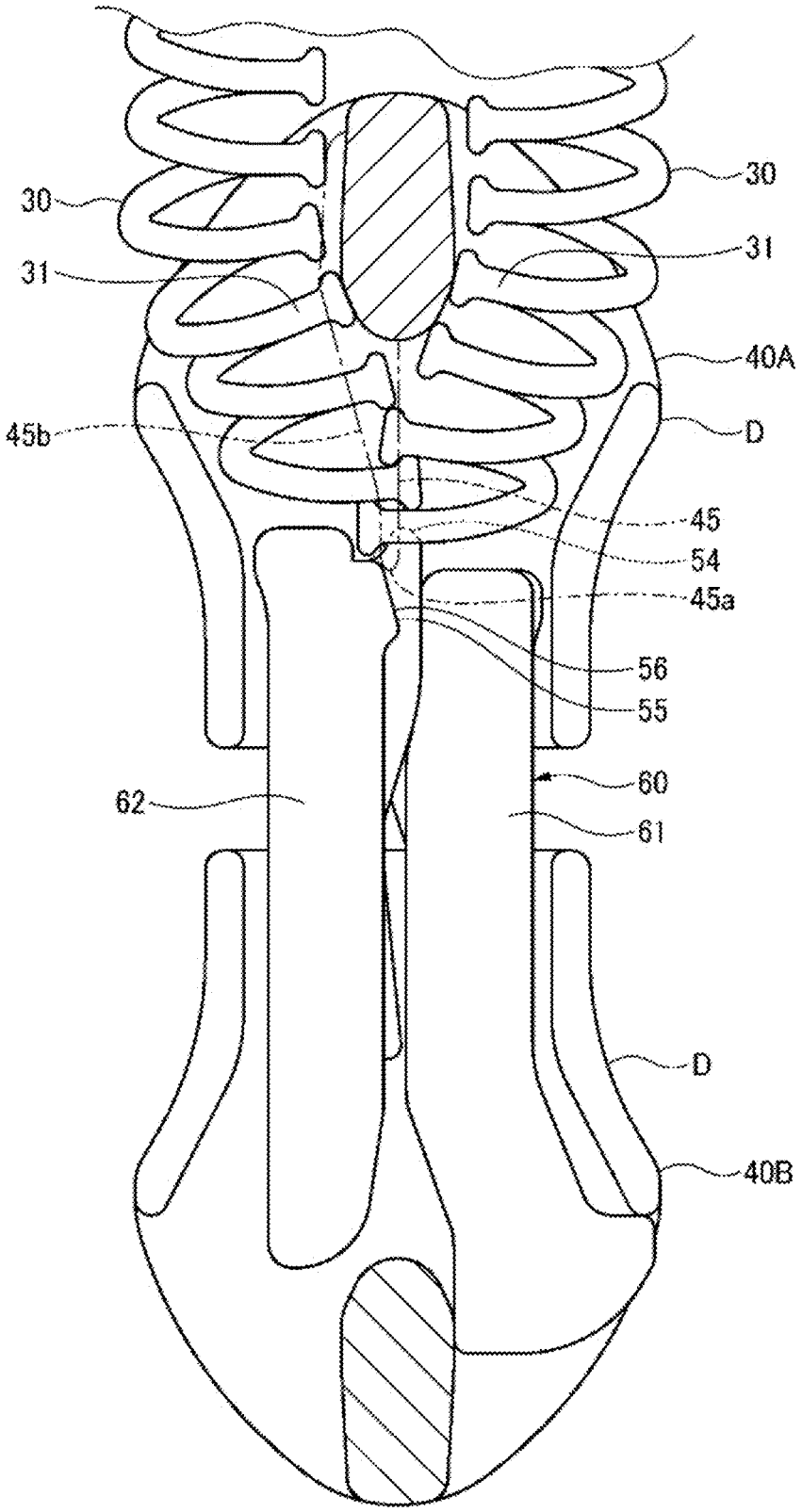
FIG. 7 is a partially broken top view explaining a case where the present invention is applied to a reversible separable stop.

For example, although the case where the present invention is applied to the separable stop 50 is illustrated in the foregoing embodiment, the present invention is not limited thereto, but may be applied to a reversible separable stop 60 shown in FIG. 7. As shown in FIG. 7, the reversible separable stop 60 includes a retainer pin 61, which is formed on a rear end portion of the tape side edge portion 20*a* of the right fastener tape 20, and a separable pin 62, which is formed on a rear end portion of the tape side edge portion 20*a* of the left fastener tape 20 and is capable of being inserted into a front slider 40A and a rear slider 40B. The contact portion 55 having the inclined surface 56 as described above is formed on the separable pin 62. Also, in this case, the raised portion 45 as described above is formed on the front slider 40A. Herein, it can be said that the rear slider 40B is one of components constituting the reversible separable stop 60. While the rear slider 40B is positioned on a bottom end of the retainer pin 61, the separable pin 62 can be inserted into the rear slider 40B.

Further, although the case where the present invention is applied to a for-back-side slide fastener with fastener element rows arranged on lower surfaces of fastener tapes is illustrated in the foregoing embodiment, the present invention is not limited thereto, but may be applied to a for-front-side slide fastener with fastener element rows arranged on upper surfaces of fastener tapes. In this case, the raised portion of the slider is provided on the upper surface of the lower plate of the slider, and the contact portion of the separable pin is provided on the lower surface side of the fastener tape. Also, the raised portion in this case extends on the upper surface of the lower plate rearward from the periphery of the guide post and is raised from the upper surface of the lower plate toward the upper plate.

Figure 8:
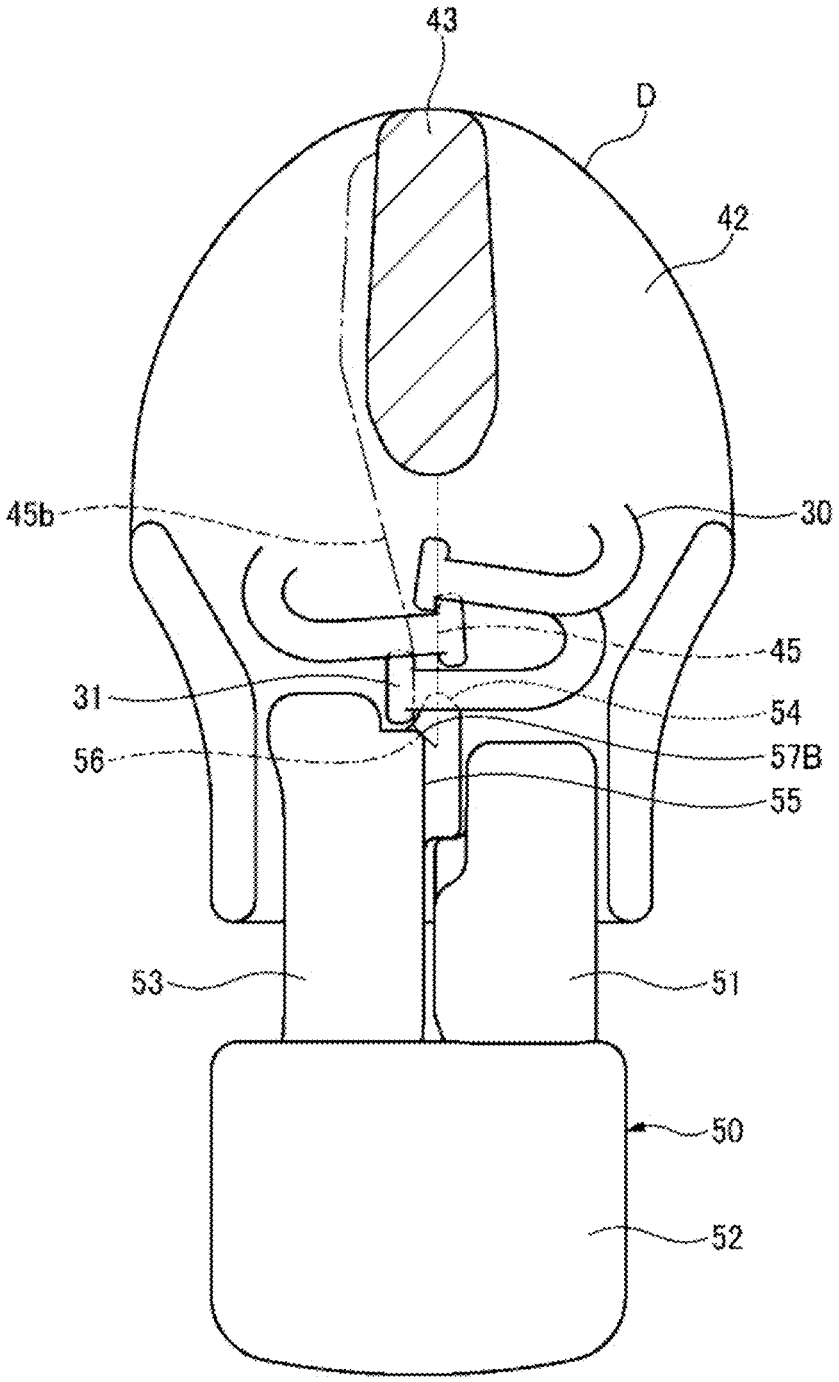
FIG. 8 is a partially broken top view explaining a case where an inclined surface as an intersecting portion is provided on the raised portion of the slider.

Further, although in the forgoing embodiment, the inclined surface 56, which is the intersecting portion, is provided on the contact portion 55 of the separable pin 53, the present invention is not limited thereto. Alternatively, as shown in FIG. 8, the inclined surface 56, which is the intersecting portion, may be provided on the raised portion 45 of the slider 40. In this case, the inclined surface 56 is provided on the distal end portion 45*a* of the raised portion 45. When the slider 40 is moved to abut against the retainer box 52, the inclined surface 56 of the raised portion 45 abuts against a corner portion 57B of the contact portion 55 of the separable pin 53, thereby move the separable pin 53 outward in the widthwise direction. Further, the inclined surface 56, which is the intersecting portion, may be provided on both the contact portion 55 of the separable pin 53 and the raised portion 45 of the slider 40. In addition, the intersecting portion is not limited to the inclined surface, but is sufficient so long as the intersecting portion has a surface which descends from the starting point B thereof toward the apex A. For example, the intersecting portion may be a curved surface.

DESCRIPTION OF REFERENCE NUMERALS

10: Slide Fastener
11: Top Stop
20: Fastener Tape
20*a*: Tape Side Edge Portion
30: Fastener Element Row
31: Fastener Element
40: Slider
41: Upper Plate
42: Lower Plate
43: Guide Post
45: Raised Portion
45*a*: Distal End Portion (Contact Portion of Raised Portion)
45*b*: Element Guide Surface
48: Separable Pin Guide Groove
50: Separable Stop
51: Retainer Pin
52: Retainer Box

53: Separable Pin
54: Projection
55: Contact Portion
56: Inclined Surface (Intersecting Portion Obliquely Intersecting with Moving Direction of Slider)
57: Corner Portion
A: Apex of Inclined Surface
B: Starting Point of Inclined Surface
L1: Width of Separable Pin as Measured at Apex of Inclined Surface
L2: Width of Separable Pin as Measured at Rear of Inclined Surface
W: Width of Separable Pin Guide Groove
H1: Dimension of Separable Pin in Upper and Lower Direction
H2: Dimension between Lower Surface of Upper Plate of Slider and Upper Surface of Lower Plate of Slider in Upper and Lower Direction
H3: Dimension of Distal End Portion of Raised Portion of Slider in Upper and Lower Direction

The invention claimed is:

1. A slide fastener comprising:
a pair of fastener tapes;
a pair of fastener element rows respectively attached to opposing side edge portions of the pair of fastener tapes;
a slider for engaging and disengaging the pair of fastener element rows with and from each other; and
a separable stop provided on one end side of the pair of fastener element rows,
wherein the separable stop comprises a retainer pin provided on one of the fastener tapes and a separable pin provided on the other of the fastener tapes,
wherein the separable pin has a projection configured to be engaged with a fastener element at one end of one of the fastener element rows on the one of the fastener tapes,
wherein the slider comprises:
an upper plate and a lower plate which are arranged to be spaced from each other in an upper and lower direction and to be parallel to each other;
a guide post connecting the upper plate with the lower plate at front end portions thereof; and
a raised portion configured in such a manner that the raised portion extends on a lower surface of the upper plate rearward from a periphery of the guide post and is raised from the lower surface of the upper plate toward the lower plate, or that the raised portion extends on an upper surface of the lower plate rearward from the periphery of the guide post and is raised from the upper surface of the lower plate toward the upper plate,
wherein the raised portion of the slider and the separable pin have respective contact portions configured to come in contact with each other in a moving direction of the slider, and
wherein at least one of the contact portion of the raised portion of the slider and the contact portion of the separable pin is provided with an intersecting portion obliquely intersecting with the moving direction of the slider.

2. The slide fastener according to claim 1,
wherein the separable pin has a main body portion,
wherein the main body portion comprises:
a side surface facing the retainer pin;
a base protruding toward a front side of the main body portion and protruding from the side surface toward the retainer pin;
the projection protruding forward from a front surface of the base; and
the contact portion located at the rear of the projection and above the base and included in the side surface,
wherein the intersecting portion is provided on the contact portion of the separable pin and the intersecting portion has an apex at a site on the intersecting portion, which is located closest to the retainer pin, and a starting point at a site on the intersecting portion, which is located at a frontmost portion of the separable pin,
wherein the contact portion of the raised portion of the slider is a distal end portion configured to come in contact with the contact portion of the separable pin, and
wherein in a state where the projection of the separable pin is engaged with the fastener element, the apex of the intersecting portion is positioned closer to the retainer pin relative to an apex of the distal end portion of the raised portion of the slider, and the starting point of the intersecting portion is positioned away from the retainer pin relative to the apex of the distal end portion of the raised portion of the slider.

3. The slide fastener according to claim 2, wherein a width of the separable pin as measured at the apex of the intersecting portion is smaller than a width of a separable pin guide groove of the slider for guiding insertion of the separable pin.

4. The slide fastener according to claim 2, wherein a width of the separable pin as measured at the rear of the intersecting portion is smaller than a width of the separable pin as measured at the apex of the intersecting portion.

5. The slide fastener according to claim 1, wherein the intersecting portion is an inclined surface.

6. The slide fastener according to claim 5, wherein the inclined surface extends rearward from a corner portion of the separable pin toward the retainer pin.

7. The slide fastener according to claim 5, wherein a dimension (H1) of the separable pin in the upper and lower direction, a dimension (H2) between the lower surface of the upper plate of the slider and the upper surface of the lower plate of the slider in the upper and lower direction, and a dimension (H3) of the contact portion of the raised portion of the slider in the upper and lower direction have a relationship of H3>(H2-H1).

8. The slide fastener according to claim 1, wherein when the slide fastener is a slide fastener in which the fastener element rows are arranged on lower surfaces of the fastener tapes, the raised portion of the slider is provided on the upper plate of the slider and the contact portion of the separable pin is provided on an upper surface side of the fastener tapes.

9. The slide fastener according claim 1, wherein when the slide fastener is a slide fastener in which the fastener element rows are arranged on upper surfaces of the fastener tapes, the raised portion of the slider is provided on the lower plate of the slider and the contact portion of the separable pin is provided on a lower surface side of the fastener tapes.

* * * * *